US005341665A

United States Patent [19]

Christophel et al.

[11] Patent Number: 5,341,665

[45] Date of Patent: Aug. 30, 1994

[54] TOOL SYSTEM FOR AN ANNULAR SHEET METAL PART

[75] Inventors: Bernard G. Christophel, Ris Orangis; Jean M. Dautremont, Melun; Pierre H. Fert, Bondoufle; Guy R. Harmegnies, Courcouronnes, all of France

[73] Assignee: Societe Nationale d'Etude et de Construction de Moteurs d'Aviation "S.N.E.C.M.A.", Paris, France

[21] Appl. No.: 850,294

[22] Filed: Mar. 12, 1992

[30] Foreign Application Priority Data

Mar. 14, 1991 [FR] France ..... 91 03066

[51] Int. Cl.[5] ..... B21D 5/14; B23K 37/00

[52] U.S. Cl. ..... 72/166; 228/17.5; 72/133

[58] Field of Search ..... 72/133, 166; 228/17.5

[56] References Cited

U.S. PATENT DOCUMENTS

| | | | |
|---|---|---|---|
| 2,315,535 | 4/1943 | McCann | 72/133 X |
| 3,978,704 | 9/1976 | Fridman et al. . | |
| 4,082,935 | 4/1978 | Lampietti et al. | 228/17.5 X |
| 4,428,215 | 1/1984 | Hume | 72/133 |
| 4,856,312 | 8/1989 | Alznauer | 72/133 |

FOREIGN PATENT DOCUMENTS

| | | | |
|---|---|---|---|
| 838202 | 2/1976 | Belgium . | |
| 0136581 | 4/1985 | European Pat. Off. . | |
| 1223970 | 2/1960 | France . | |
| 2311607 | 12/1976 | France . | |
| 411940 | 9/1974 | U.S.S.R. | 228/17.5 |
| 1074622 | 2/1984 | U.S.S.R. | 72/133 |

OTHER PUBLICATIONS

Patent Abstracts of Japan, vol. 8, No. 28 (M-274) (1465), Feb. 7, 1984, & JP-A-58 187 227, Nov. 1, 1983, Takashi Hashimoto, et al., "Manufacture of Lock Bush".

*Primary Examiner*—Timothy V. Eley

*Attorney, Agent, or Firm*—Oblon, Spivak, McClelland, Maier & Neustadt

[57] ABSTRACT

The process and apparatus of the invention permits the production of annular parts, such as ferrules, on which machining operations are to be carried out. The process includes the steps of bending a predimensioned metal sheet by a series of internal supports mounted on a rotary plate and by a pressure roller bearing on the outer surface of the sheet. One complete rotation of the rotary plate makes it possible to completely bend the sheet into the form of a ferrule. The second main operation includes carrying out of a welding operation on the two ends of the metal sheet. This process makes it possible to carry out any random prior machining operation on the predimensioned flat metal sheet, without the machining operations being impaired by the bending or welding operation. The process is applicable to the production of front ferrules for casings surrounding the coldest pipe of a double flow turbojet engine.

5 Claims, 6 Drawing Sheets

TOOL SYSTEM FOR AN ANNULAR SHEET METAL PART

BACKGROUND OF THE INVENTION

1. Field of the Invention

The invention relates to the production of annular parts by means of a generally flat metal sheet and whose initial shape is predetermined in order to form, once deformed, the annular part to be obtained. The invention is advantageously used when machining operations are to be carried out on said part. The invention has more particularly been developed for producing a slightly conical, front ferrule of an aircraft turbojet engine casing.

2. Description of the Prior Art

Double flow turbojet engines constitute one propulsion engine type for aircraft. Their overall shape can be likened to a cylinder having a length of several meters, the external diameter varying constantly as a function of the construction of the different parts of the engine. For example, at the coldest flow pipe surrounding the engine, the casing has a shape which widens slightly and then becomes cylindrical, before finally reassuming a conical shape in order to reduce the diameter of said coldest flow pipe. Therefore the engine casing is often constituted by a succession of annular ferrules, whose shapes have varying degrees of complication and on which numerous machining operations take place with a view to fixing the different accessories (inspection means, ducts, control means, etc.). Moreover, these machining operations frequently include the hollowing out of the ferrule in order to reduce its weight.

For example, a front ferrule of a casing at the coldest flow pipe can be constituted by a slightly conical, titanium ferrule, whose diameter can be between 500 and 1000 mm. It is often obtained from a metal sheet with a thickness close to 7 mm and which is then hollowed out by a machining operation in order to lighten the same and provide the fixing of various accessories, while still leaving ribs in order to rigidify the part. Such a part can be obtained in different ways.

One conventional method for shaping the metal sheet, which is known as "ferruling", consists of cambering or bending the sheet between several rollers positioned on either side thereof. The definitive radius of curvature is obtained by the successive passage of the sheet between these rollers. Once bent, the ferrule is terminated by welding in accordance with two generatrixes using conventional equipment. This method makes it necessary to carry out machining operations following the cambering or bending, because the pressure forces of the rollers would lead to the flattening or inclination of numerous ribs resulting from the machining. It is then necessary to machine the part following said bending operation, which is relatively difficult and expensive. Thus, the machining of a ferrule with a diameter of approximately 800 mm and having at numerous locations a thickness of 1 or 2 mm is very difficult. However, such a machining can be brought about chemically, the ferrule being immersed in a large tank provided for this purpose, but said method is very expensive and difficult to perform.

Another method used consists of carrying out bending by successive folds using a conventional folding machine. The folds are made along the generatrixes, which have a reduced inertia compared with the others. This method suffers from the disadvantage that folding marks on the ribs are left behind after said bending operation. Moreover, in this method, the metal is exposed to stresses exceeding the yield strength or modulus of elasticity of the metal.

The aim of the invention is to produce such parts by shaping the metal sheet into a ferrule after carrying out all necessary machining operations on the flat sheet, so as to avoid using chemical working or machining.

SUMMARY OF THE INVENTION

Therefore a first main object of the invention is a process for the production of an annular axis of revolution part from a flat metal sheet, whose shape is predimensioned for this purpose.

According to the invention, the process consists of progressively bending the metal sheet on winding it by a first end about the axis of revolution by means of a pressure roller, which exerts a pressure by rolling on the surface of the sheet which is to become the outer surface of the annular part, so as to join two opposite ends of the sheet to one another, while using deformation forces remaining below the yield strength of the metal from which the sheet is made and then the two joined ends are welded.

Such a bending by the progressive deformation of the sheet makes it possible to machine the latter prior to carrying out said shaping.

The process is preferably performed using internal supports for guiding the inner surface of the sheet during the deformation. Holding brackets can be placed in each case facing an inner support in order to hold the thus deformed sheet.

In order to eliminate a major part of the stresses produced by the bending operation, it is proposed that a thermal expansion treatment be carried out after welding. As a function of the materials used and more particularly in the case of titanium alloy parts, this operation can be carried out at approximately 450° to 550° C. for between 2 and 6 hours. Such an expansion heat treatment can also be followed by a thermal calibration or gauging phase.

The process according to the invention applies more particularly to the production of a ribbed, conical, titanium ferrule with shapes to be fashioned onto at least one of the surfaces of the sheet, the machining of all these shapes taking place prior to the shaping by bending of the sheet.

The second main object of the invention is a tool system for performing the process as summarized hereinbefore. It comprises a plate rotating about an axis, which is the axis of revolution of the annular part to be obtained and which is rotated by a motor and on which are mounted the inner supports fixed to a base; a first means for fixing a first end of the sheet to the rotary plate with an inclination corresponding to that of the generatrixes of the part formed; a pressure roller mounted so as to rotate about a rotation axis parallel to said inclination of the generatrixes and coplanar to the axis of the rotary plate; and second mobile means for fixing the second end to the first end of the metal sheet.

The first and second fixing means comprise a fixing block mounted in fixed manner on the rotary plate, a flange for fixing the first end to the fixing block, a mobile block, a mobile flange for fixing the second end of the sheet to the mobile block close to the first end of the sheet and screws for fixing the mobile and fixing flanges.

The rotary plate is advantageously completed by several inner supports fixed in a regulatable manner relative to the rotary plate in order to guide the inner surface of the metal sheet during bending. In this case, the tool system is advantageously completed by fixing brackets, each bracket being positioned facing an inner support, so that there is no deformation of the sheet once it has been bent.

These inner supports are preferably in the form of a semicylinder, the effective support points being constituted by. the generatrix of each semicylinder furthest from the axis of the rotary plate.

In order to permit the welding on said tool system of the two opposite ends to be welded to one another, level with the junction of the two ends of the sheet, the fixing flange and the fixing block are not contiguous with the mobile flange and the mobile block, so as to leave an opening on either side of the sheet at the location of the junction of the two ends to be welded, so as to permit welding before the tool system is removed from the shaped part.

Preferably, the tool system comprises hooks fixed to the mobile flange and which are intended to be attached around the fixing flange and fixing blocks, set screws being screwed into the hooks to permit the complete moving together of the two opposite ends to be welded. In order to carry out said welding operation, the welding head can advantageously be mounted on the rotary plate mobile in translation along the junction to be welded. To permit welding, an argon circulation can be provided in the two mobile and shaping blocks.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

1) Process

FIGS. 1A to 1F illustrate the bending of a sheet 2 according to the invention, followed by a welding phase for said sheet.

Figure 1A:
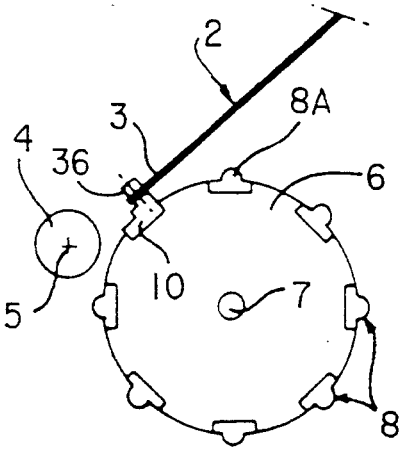
FIGS. 1A to 1F shows the production process according to the invention.

FIG. 1A shows a metal sheet 2, whereof a first end 3 is fixed to a rotary plate 6 about a vertical axis or spindle 7. For this purpose use is made of first fixing means constituted by a fixing block 10 and a fixing flange 36. The sheet 2 is thus tangentially fixed to the rotary plate 6. A roller 4 mounted so as to rotate about a second axis 5 is placed alongside the rotary plate 6, so that its periphery is very close to the fixing block 10 of the rotary plate 6 when the latter is rotated, said roller being a pressure roller.

Figure 1B:
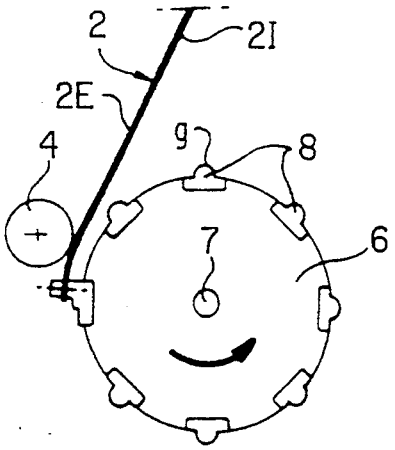

Thus, as shown by the curved arrow in FIG. 1B, when the rotary plate 6 is rotated about its vertical axis, the fixing block 10 of the rotary plate 6 drives the sheet 2 about the rotary plate 6. The presence of the pressure roller 4 maintains the sheet in the vicinity of the rotary plate 6 by bearing on its outer surface 2E. This starts the winding of the sheet 2, by torsion or bending, about the rotary plate 6. To guide said bending of the sheet 2, several inner supports 8 are fixed to the periphery of the rotary plate 6 in the same way as the fixing block 10. The top 9 of each inner support 8 is placed at a distance from the vertical rotation axis 7 of the rotary plate 6 equal to the radius of the part to be obtained.

Figure 1C:
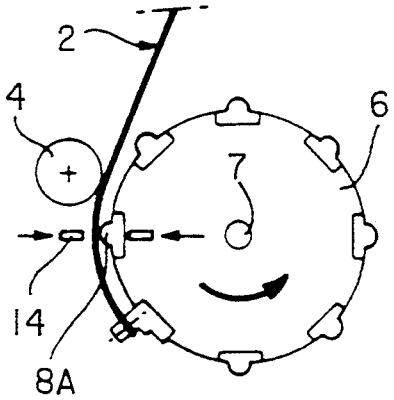

If, as shown in FIG. 1C, the rotation of the plate 6 continues, the sheet 2 is rotated about said plate 6, the pressure roller 4 applying the inner surface 2I of the sheet 2 to the tops 9 of the successive inner supports 8. To assist the maintaining in place of the metal sheet 2 around the rotary plate 6, use is preferably made of holding brackets 14, each positioned facing an inner support 8. Therefore the sheet 2 is made to stay in place around the rotary plate 6 and the inner supports 8, no matter what stresses result from this deformation.

Figure 1D:
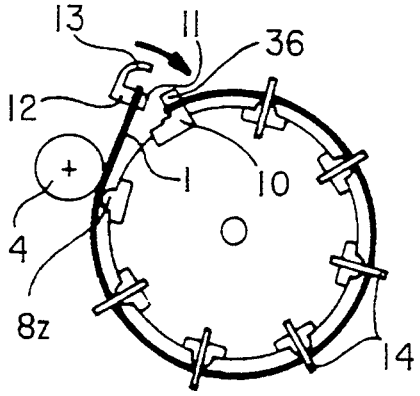

FIG. 1D shows the end of the sintering of the sheet 2 when the final inner support 8Z arrives at a position facing the pressure roller 4. The second end 1 of the metal sheet 2, or its rear end is always free. However, mobile fixing means have been previously fixed to said second end 1 of the metal sheet 2. They are constituted by a mobile block 11 and a mobile flange 12. The latter is provided with at least two hooks 13 which are attached round the flange 36 and the fixing block 10 of the rotary plate 6.

Figure 1E:
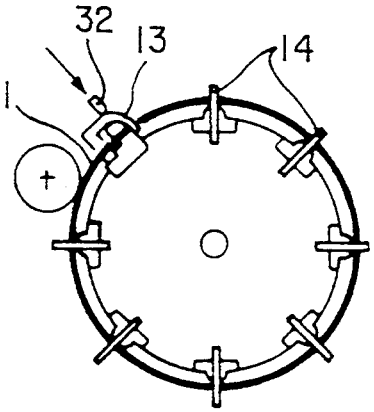

Thus, on completing the rotation of the plate 6, the free end 1 of the sheet 2 is brought into the vicinity of the first end 3 of the sheet 2 fixed to the fixing block 10 of the plate 6. A mechanism for fixing the hook 13 to the fixing flange 10 permits the anchoring of the flange 11 and the mobile block 12 on the flange 36 and the fixing block 10 of the rotary plate 6. The bending of the sheet 2 is then terminated. A locking bar 32 makes it possible to maintain said fixing action, as shown in FIG. 1E.

Figure 1F:
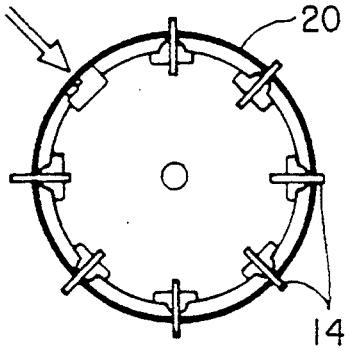

The second main phase of the process according to the invention consists of welding the thus joined ends 1 and 3 to one another. FIG. 1F symbolizes this welding operation by the arrow perpendicular to the sheet 2 indicating the location of the junction of the two ends 1 and 3 of the sheet 2. The shapes of the fixing elements are such that the welding operation can be performed prior to the dismantling of the thus bent sheet 2 with respect to the tool system. These shapes will be described hereinafter.

The thus shaped annular part 20 is consequently bent and welded. The initial sheet 2 has obviously been prepared and dimensioned so that, after bending, the two ends 1 and 3 face one another and permit welding.

FIGS. 1A to 1F tend to suggest that the shaped part 20 is cylindrical. However, the cylinder is only one of the numerous possible shapes which can be obtained. Thus, it is in particular possible to produce conical ferrules. In the latter case, the initial metal sheet 2 would not be rectangular when in place. Its shape must be that of a circular sector or an elongated, twisted rectangle. The latter shape can be seen in FIG. 2. The shape and position of the inner supports 8 also determine the shape of the part to be obtained.

No matter what the final shape of the part 20, the latter has undergone severe stressing during bending.

The latter operation is carried out without the metal undergoing mechanical stresses exceeding its yield strength, so that the bending stresses remain within the shaped part 20. However, the latter is constantly exposed to stresses. In order to eliminate this phenomenon, which could have harmful consequences and subject the weld to high tensile forces, it is preferable for the shaped part 20 to undergo an expansion heat treatment. The latter can consist of exposing the part 20 to a temperature close to 500° C. (450° to 550° C.) for approximately 4 hours (between 2 and 6 hours), particularly in the case of titanium alloy parts.

In the case where it is wished to obtain a part having a very precise shape, i.e. with very close dimensional tolerances, it is preferable to carry out a thermal calibration or gauging after the thermal expansion treatment. This operation consists of heating the part obtained, so that its diameter increases very slightly and is then left to cool on a calibrated mold. The external diameter of the latter is the internal diameter of the part to be obtained. During cooling, the part 20 consequently retracts on the template and its internal diameter precisely corresponds to the external diameter of the template.

2) Tool System

Figure 2:
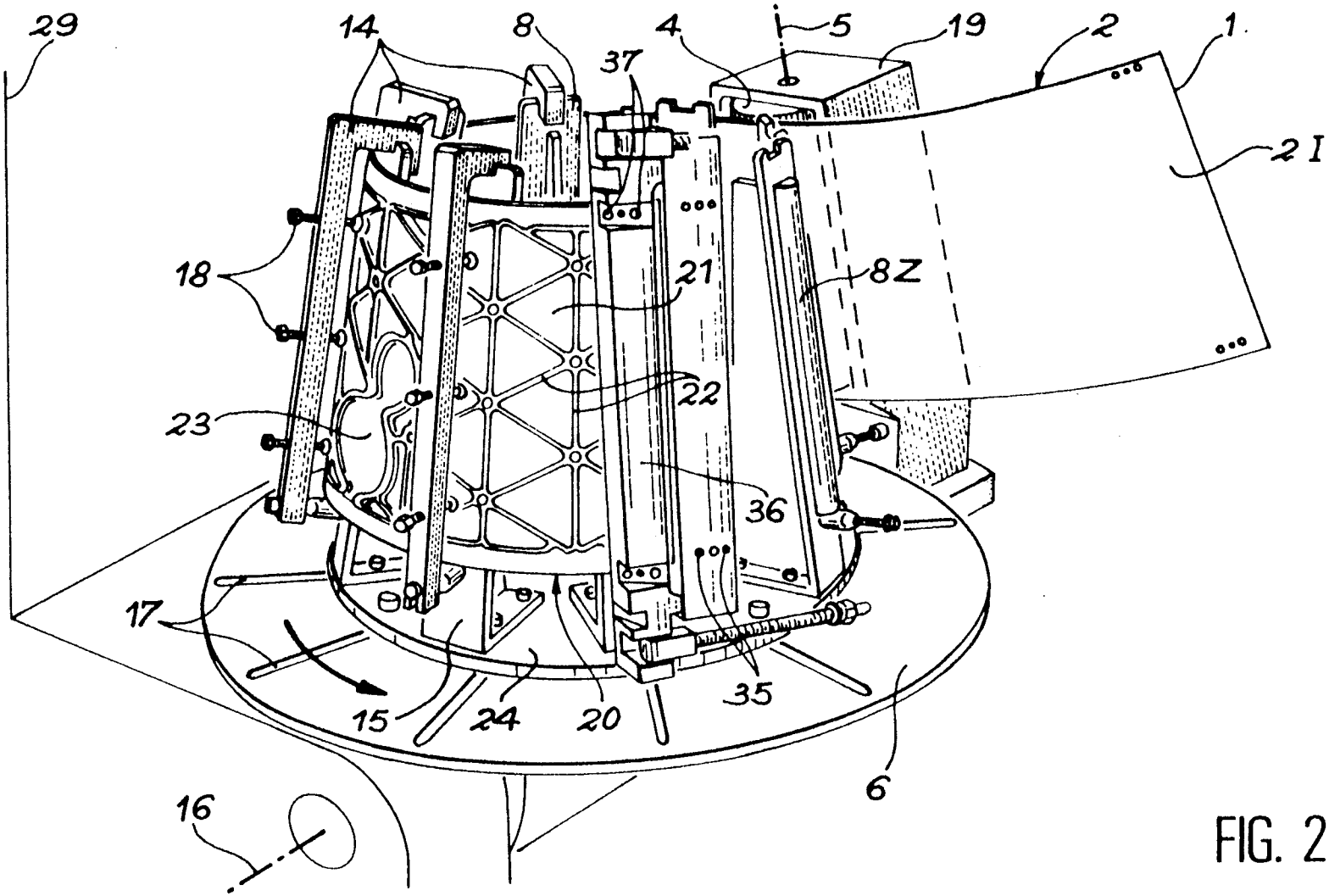
FIG. 2 illustrate the tool system according to the invention during bending of the metal sheet.

FIG. 2 shows a tool system making it possible to perform the abovedescribed process and more particularly in such a way as to obtain a front ferrule of a double flow turbojet engine casing at the cold flow pipe. Such a ferrule is made from titanium, which is a strong metal, has a good machinability and a relatively low density compared with other metals. This ferrule is produced from a sheet with a thickness of approximately 7 mm. However, it is necessary to hollow out said sheet to make it even lighter. Thus recesses 21 are provided in such a way that ribs 22 are left on the surface of the part, so as to ensure that the latter retains an adequate rigidity. Numerous shapes are provided in such a ferrule 20. For example, two bosses 23 are shown on the ferrule 20. Therefore the ferrule 20 is a part having extra thicknesses in a frequent and irregular manner.

The initial sheet 2 is shown with a slightly twisted, elongated rectangular shape. This shape corresponds to the developed shape of the final ferrule 20. In FIG. 2, the sheet is being bent. It is possible to see brackets 14, which have already been positioned facing their corresponding inner supports 8. These supports are mounted by their respective feet 15, preferably on a base 24 of the tool system, which is mounted on the rotary plate 6 of a machine 29. Radial slots 17 permit the positioning of the tool system on the plate 6.

Keeping the sheet centered by means of brackets takes place in a more precise manner with the aid of pressure screws 18 screwed into the brackets 14.

In FIG. 2, the fixing block is covered with a fixing flange 36 traversed by at least two groups of fixing screws 37, which fix said first end 3 of the sheet with respect to the fixing block. For this purpose the sheet contains holes.

It is also possible to see the pressure roller 4 mounted around the spindle or axis 5 in a protective cap 19. The assembly of the pressure roller 4 and its cap 19 is mounted so as to be mobile in horizontal translation with respect to the machine frame 29 on which the tool system is mounted in a rotary manner. This makes it possible to adapt the position of the pressure roller 4 relative to the diameter of the part to be obtained, corresponding with the setting of the position of the inner supports 8 of the tool system on the rotary plate 6.

To the right in the drawing, the second end 1 of the sheet has been shown in its initial form, i.e. flat. Therefore the inner face 21 is still visible and will be applied to the final inner support 8Z, whose bearing semicylinder is still visible. Other elements of the tool system can be seen and will be described in greater detail hereinafter relative to the other drawings.

Figure 3:
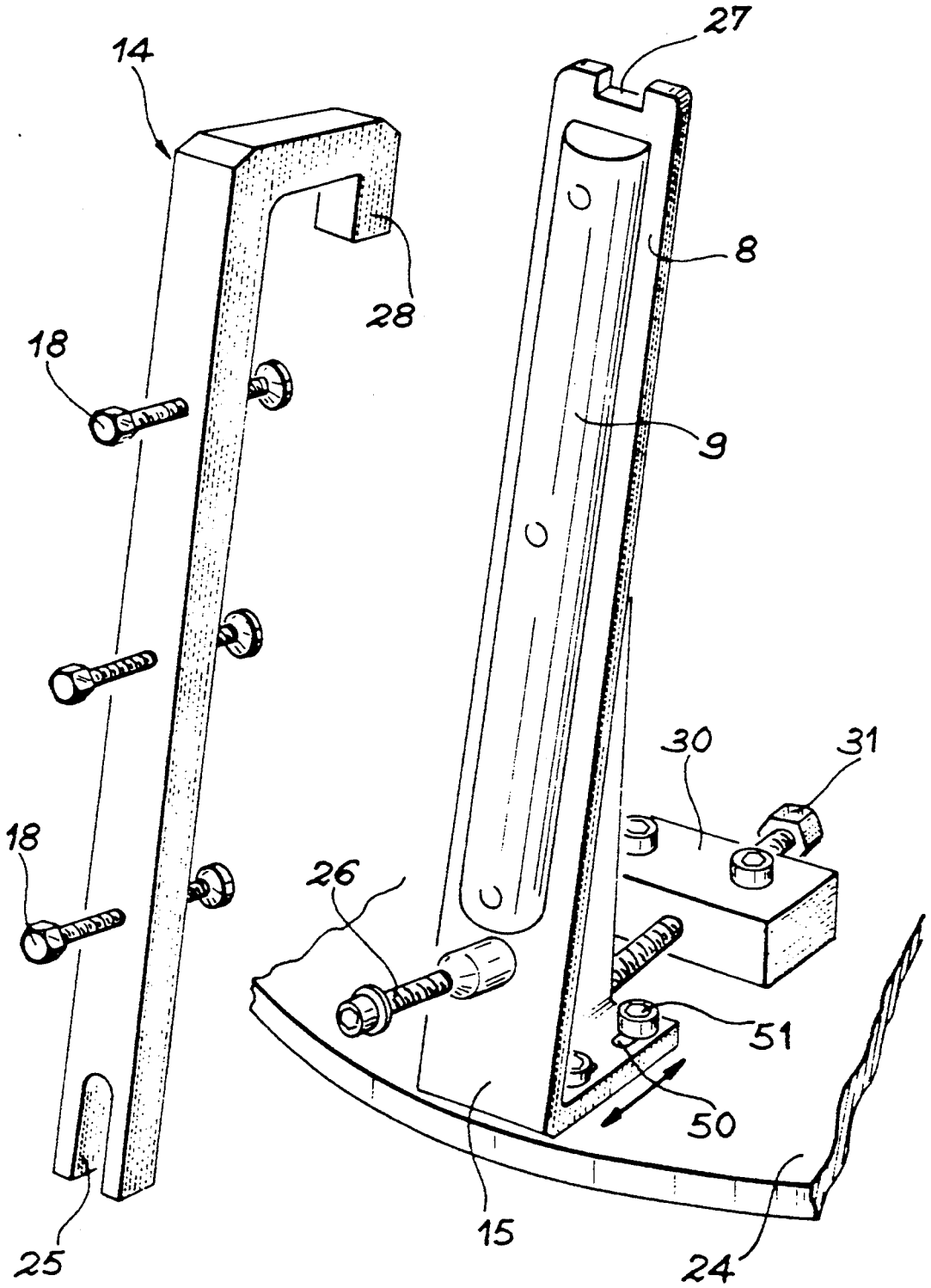
FIG. 3 shows an inner support in the form of a semicylinder and its corresponding bracket.

FIG. 3 shows in detail the brackets 14 for fixing the sheet to the inner supports 8. These brackets 14 are constituted by a metal bar terminated by a hook 28, which is positioned behind the upper portion of the inner support 8, in a notch 27. The pressure applied to the outer surface of the sheet is obtained by the screwing of several screws 18 screwed into the main portion of the bracket 14 and whose widened end acts by pressure on the sheet. The fixing of these brackets 14 to the inner supports 8 also takes place in the lower portion as a result of a notch 25 made in the lower portion of the bracket 14 and a fixing bolt 26 mounted in the foot 15 of each of the inner supports 8.

The inner supports are mounted by their feet 15 using screws 51 on the base 24. Oblong holes 50 in the feet 15 make it possible to adapt said tool system to several different diameters of the ferrules to be obtained. Thus, by varying the spacing of the inner supports 8, it is easy to increase or decrease the diameter of the part to be obtained.

It is possible to set the position of the inner supports 8 by means of an abutment 30, into which is screwed a setscrew 31 acting on the base of the foot 15 of each inner support 8.

In the described construction, the operational portion of the inner supports 8 has been shown in the form of a semicylinder 9, whose generatrix is located at the top thereof and is the part on which the sheet bears. This type of inner support only constitutes one example, other equivalent elements being conceivable and usable for producing an adequate group of supports within the metal sheet.

Figure 4:
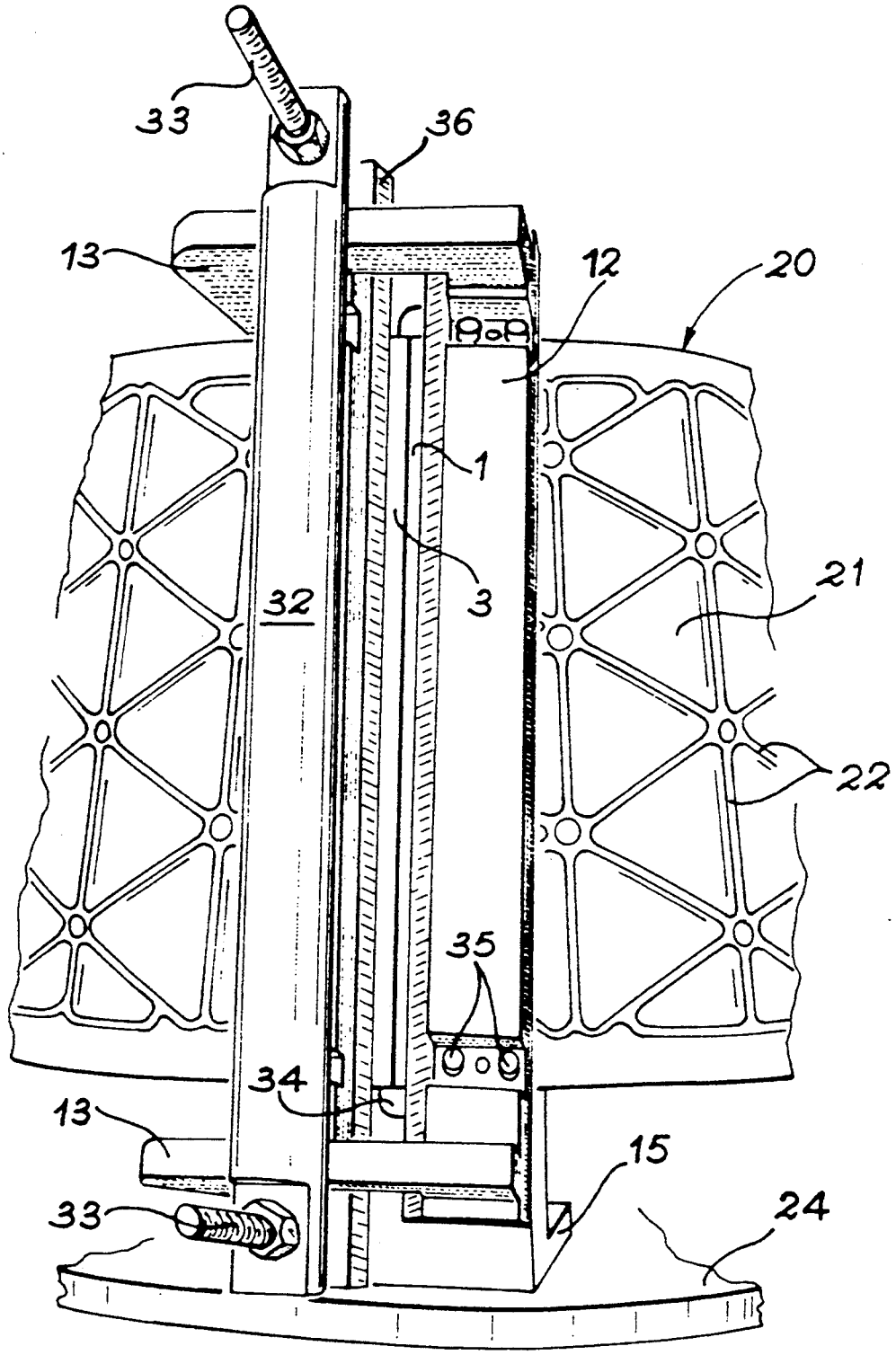
FIG. 4 illustrates the two fixing means for the two sheet ends.

FIG. 4 corresponds to the phase of the process shown in FIG. 1E. The sheet is completely bent and forms a ferrule 20, the two ends 1 and 3 being engaged with one another. FIG. 4 shows in detail the fixing means for the two sheet ends 1 and 3, so that the latter are joined to one another. The fixing block is covered by the fixing flange 36 covering the first end 3. The second sheet end 1 is covered by the mobile flange 12 traversed by two other groups of fixing screws 35, which fix said second end in the fixing block.

To permit the fixing of the second end 1 to the first end 3, hooks 13 shown in FIGS. 1D and 1A are fixed to the mobile flange 12. Their shape enables them to be hooked behind the fixing block and flange 36. Once in place, they are locked in this position by a fixing bar 32, which is kept secured against the fixing flange by two bolts 33.

The fixing flange 36 and the mobile flange 12, once the two sheet ends 1 and 3 have been joined together, form a slot 34 at the bottom of which is located the junction plane of these two ends 1 and 3. This slot makes it possible to weld the two sheet ends 1 and 3 before the tool system for securing and holding the sheet is removed.

Figure 5:
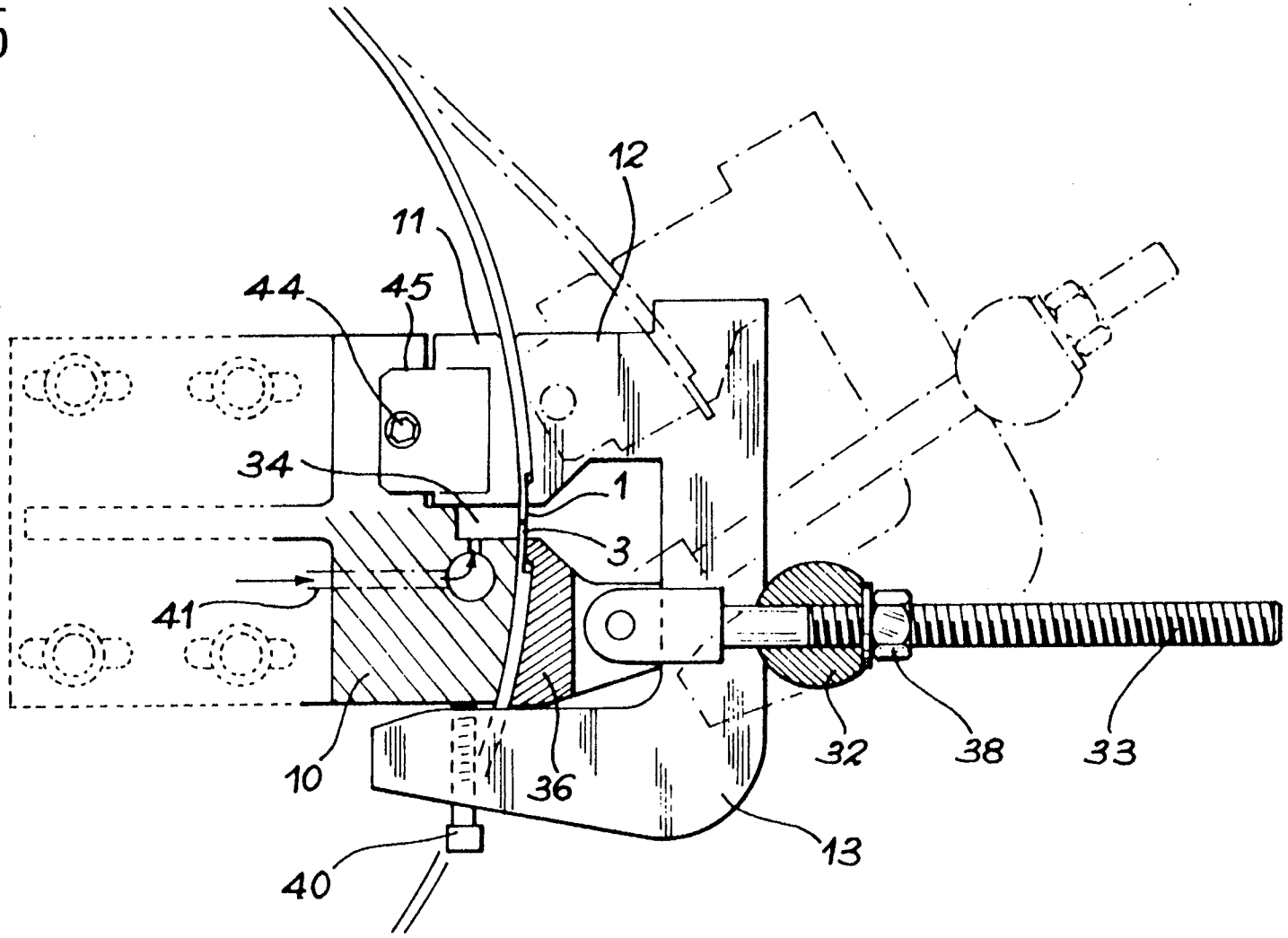
FIG. 5 shows in section and in silhouette, the fixing of a hook used on the fixing means.

The operation of the mechanism for fixing these two ends 1 and 3 is explained by FIG. 5. It is possible to see in section therein the fixing block 10 fixed to the base and against which is placed the first sheet end 3, which is kept against it by the fixing flange 36. Just to the side thereof, but represented without hatching, are located the mobile block 11 and mobile flange 12 in which is fixed the second sheet end 1. The complete mobile block 11 has a shape complementary to that of the fixing block 10 so that it can be housed in the latter.

When the sheet has been completely bent, the mobile block 11, the mobile flange 12 and the second end 1 are approached with respect to the fixing block 10 and the fixing flange 36, as is indicated by their position shown in silhouette form, i.e. in mixed lines. Thus, the second sheet end 1 has not undergone the pressure roller bending. Consequently it does not have a tendency to curve again and pass directly against the first sheet end 3. As a result, there are difficulties in placing the hooks 13 behind the assembly formed by the block 10 and the fixing flange 36. To this end, use is made of an approach tool system constituted by bolts 33 mounted so as to pivot on the flange 36. A nut 38 pushes the locking bar 32, which has a section which can be likened to a ball joint. In order to carry out the fixing, the bolt 33 is introduced into a hole made through the hook 13. This is followed by the screwing of the nut 38, which move the hook 13 and flange 36 together. Complete screwing makes it possible to place the hook 13 behind the block 10 and the fixing flange 36 and therefore place the second sheet end 1 against the first 3.

The initial size of the sheet may not be precisely that which would be suitable for directly carrying out a welding of the two ends 1 and 3. The tool system according to the invention provides for the use of a tension screw 40 screwed into the hook 13 and which can pass beyond the latter so as to bear against the fixing block 10. Screwing down of said tension screw 40 makes it possible to tension the sheet on moving together the first 1 and second 3 sheet ends.

It is also possible to see a duct 41, which issues within the slot 34 formed by the fixing block 10 and the mobile block 11 between the two sheet ends 1 and 3. This duct 41 symbolizes a supply network for gas, preferably argon, in order to ensure a minimum gas circulation throughout the welding operation carried out when the securing tool system is still fitted to the sheet.

Figure 6:
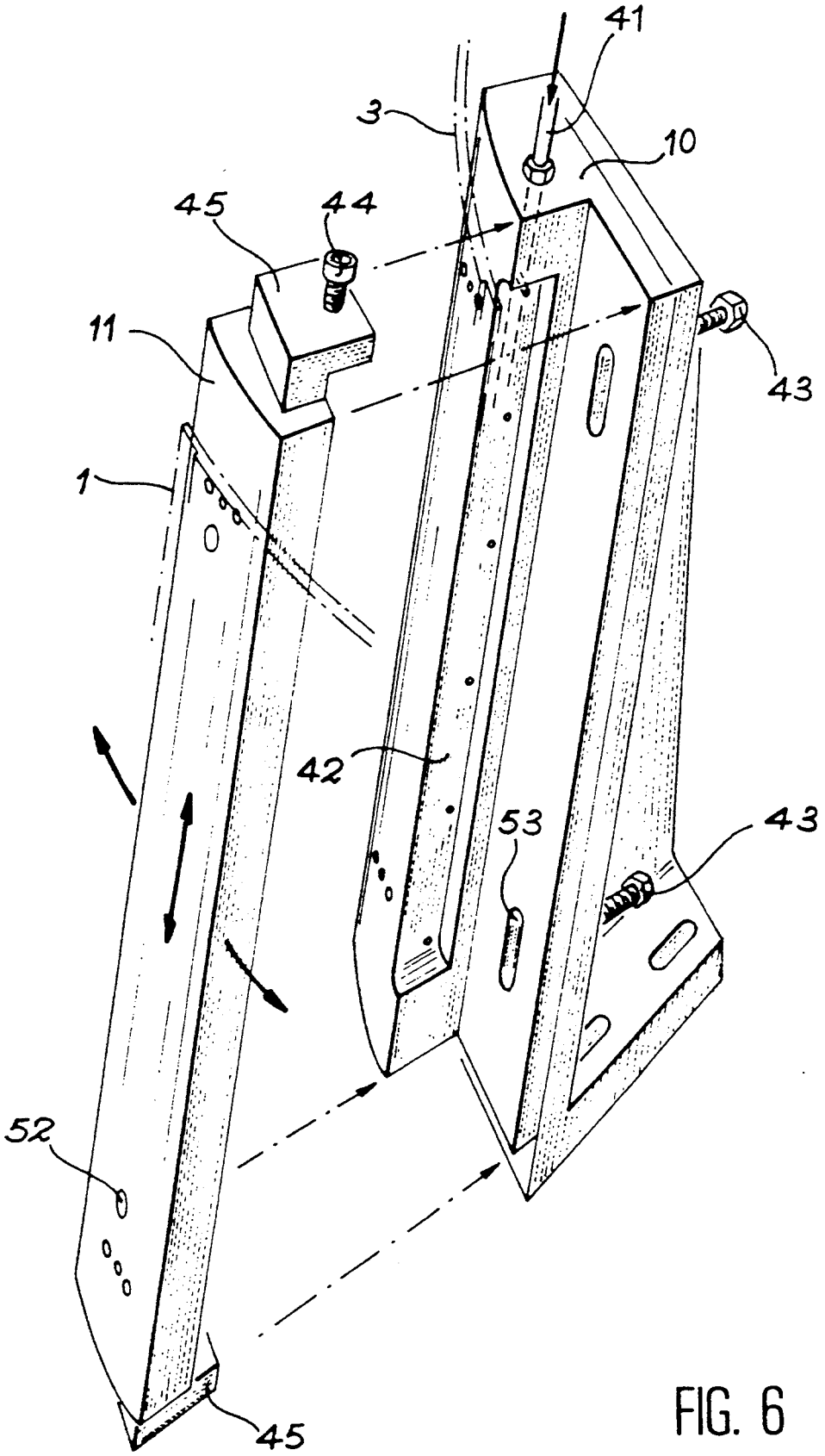
FIG. 6 shows the fitting of the mobile block to the fixing block.

The same tool system for fixing the two sheet ends 1 and 3 is shown in another embodiment in FIG. 6. The latter shows the fixing block 10 in which is inserted the mobile flange. It can be seen that the fixing block 10 has a cavity 42 making it possible to define a portion of the slot, which must be placed beneath the junction point of the two ends 1 and 3. Into the cavity 42 issues several ducts 41 making it possible to supply argon during welding. It is also possible to see locking screws 43, which fix the mobile assembly to the fixng block and traverse these elements by respective holes 52 and 53.

At the upper and lower ends of the mobile flange 12 is placed another setscrew 44 for securing the position of the two sheet ends 1 and 3. Thus, the bending of the initial sheet 2, which can have relatively irregular shapes and thicknesses, may mean that the two sheet ends 1,3 are not strictly facing one another. It is then necessary to adjust the height of one of these ends relative to the other. By using setscrews 44 screwed into two positioning tabs 45 of the mobile block 11 and bearing against the fixing block 10, it is possible to carry out such an adjustment. Therefore the two ends 1,3 can be accurately positioned, as indicated by the arrows, prior to the welding process.

The operation consists of welding the two sheet ends 1 and 3 is preferably carried out when the bending and fixing tool system is still fixed to the bent sheet. The welding head is fitted to the machine or machine frame supporting the rotary plate 6. This fitting can be brought about in such a way that the welding head is mobile in translation in order to make a weld along the entire height of the sheet in order to weld the bent sheet in a single operation.

To this end and as shown in FIG. 2, the rotary plate 6 can be mounted on a support, which pivots about a vertical axis 16 so as to pivot by 90° the assembly of the rotary plate and the tool system, so as to bring the thus formed ferrule into a position where its axis of revolution is horizontal. The welding head can thus be used if it is fitted so as to be mobile in horizontal translation on the frame 29 on which the tool system is mounted.

A main advantage of the invention is that all the machining operations which have to be carried out on the ferrule in order to be able to produce complicated parts, such as the front ferrule of a double flow turbojet engine, can be carried out prior to said bending operation. Thus, the chemical machining operations used beforehand for producing shapes after the formation of the ferrule lead to bubbling in the tanks. However, the shape of a ferrule imposes the use of very large tanks, so that the process is complicated and costly.

Another advantage of the invention is that it simply requires the presence of a frame or a machine having a rotary plate.

What is claimed is:

1. Tool system for the production of an annular part having an axis of revolution from a flat sheet having a first and second opposite ends by the progressive bending of the sheet by winding the sheet around an axis of revolution by said first end and by exerting a pressure force on the outer surface of the sheet, which becomes the outer surface of the annular part, so as to join together the first and second ends using deformation forces remaining below the yield strength of the metal and by welding the first and second ends, which comprises:

a rotary plate which surrounds the axis of revolution, is concentric with that of the annular part to be produced and on which are mounted inner supports;

a motor for rotating said rotary plate;

a fixing mechanism for fixing a first end of the sheet to the rotary plate with an inclination corresponding to that of generatrixes of the shaped part with respect to the axis of revolution;

a pressure roller mounted so as to rotate about an axis of revolution parallel to the inclination of the generatrixes and coplanar to the axis of the rotary plate;

a mechanism for fixing the second end of the sheet to the first end of the sheet wherein the inner supports are fixed in a regulatable manner to the rotary plate to guide an inner surface of the sheet during bending and the inner supports comprise semicylinders, the generatrix of each of the supports being located at point furthest from the axis of the rotary plate; an a plurality of holding brackets, each positioned facing one of said inner supports, to hold the sheet during the bending operation.

2. Tool system according to claim 1, wherein the mechanism for fixing the second end of the sheet to the first end comprises a fixing block mounted in fixed manner on the rotary plate, a flange on the fixing block for fixing the first end to the fixing block, a mobile block, a mobile flange for fixing the second end of the sheet to the mobile block in proximity with the first end of the sheet and a plurality of screws for fixing the mobile flange and fixing flange together.

3. Tool system according to claim 2, wherein at a junction of the first and second ends of the sheet, the mobile flange and the mobile block are not contiguous with the fixing flange and the fixing block in order to leave a slot on either side of the surfaces of the sheet for welding thereof

4. Tool system according to claim 3, which comprises a plurality of hooks fixed to the mobile flange and which are hooked around the fixing flange and fixing blocks, and a plurality of set screws screwed into the hooks to permit the complete moving together of the first and second ends to be welded.

5. Tool system according to claim 3, which comprises an argon gas distribution duct network located in the fixing block.

* * * * *